US007510056B2

(12) United States Patent
Bonatre

(10) Patent No.: US 7,510,056 B2
(45) Date of Patent: Mar. 31, 2009

(54) ROOF RAILING FOR AN ELEVATOR CAR ADAPTED TO BE COLLAPSED WITH A HANDLE ACTUATING ALL SIDES AT THE SAME TIME

(75) Inventor: Guillaume Bonatre, Ousson sur Loire (FR)

(73) Assignee: Otis Elevator Company, Farmington, CT (US)

( * ) Notice: Subject to any disclaimer, the term of this patent is extended or adjusted under 35 U.S.C. 154(b) by 59 days.

(21) Appl. No.: 11/816,544

(22) PCT Filed: Feb. 18, 2005

(86) PCT No.: PCT/IB2005/000430

§ 371 (c)(1),
(2), (4) Date: Aug. 17, 2007

(87) PCT Pub. No.: WO2006/087598

PCT Pub. Date: Aug. 24, 2006

(65) Prior Publication Data

US 2008/0217113 A1 Sep. 11, 2008

(51) Int. Cl.
*B66B 11/02* (2006.01)

(52) U.S. Cl. ..... 187/401; 52/30

(58) Field of Classification Search ..... 187/401, 187/402; 52/30

See application file for complete search history.

(56) References Cited

U.S. PATENT DOCUMENTS 2,753,224 A * 7/1956 Troche et al. ..... 182/113
5,230,404 A * 7/1993 Klein ..... 187/414
6,543,584 B1 * 4/2003 Miyakoshi et al. ..... 187/401

FOREIGN PATENT DOCUMENTS

EP 0985628 A2 3/2000
GB 2158038 A 11/1985
JO 2006-199404 A * 8/2006

(Continued)

OTHER PUBLICATIONS

PCT International Search Report and Written Opinion of the International Searching Authority for International application No. PCT/IB2005/000430 mailed Apr. 20, 2006.

*Primary Examiner*—Thomas J. Brahan
(74) *Attorney, Agent, or Firm*—Carlson, Gaskey & Olds

(57) ABSTRACT

The invention relates to an elevator car roof railing (1) with collapsible sides (13) hinged on a supporting frame (5) on the car roof (3), characterized in that it includes: two sides (13) that can be folded inwards as an accordion in at least two parts (15), perpendicular to the landing door opening (9) of the elevator shaft and hinged to said supporting frame (5) in their bottom part, an upper rear side bar (17) connected to the rear upper end of each of said folding lateral sides (13), an actuation handle (19) with a length approximately equal to the depth of the elevator car and hinged to said supporting frame (5) or close thereto, in the rear middle part thereof, perpendicular to said landing door opening (9) in the shaft, wherein this handle (19) is connected at least by a rod (35) hinged in the median plane to the upper rear side bar (17), and by a lateral rod with a terminal ball-and-socket joint to the rear part of each of the folding lateral sides (13), wherein said handle (19) can be lifted through the landing door opening (9) from a lower, substantially horizontal position in which the railing is collapsed, to a locked upper position that is substantially vertical, pulling along the two folding lateral sides (13) at the same time to erect them vertically and form the third rear side of the railing with the upper bar (17) on which it is applied and locked and with the rear connecting rods (35, 39) for said lateral sides (13), and inversely, can be lowered from the upper position to the lower position in which the displacement of the handle (19) causes the simultaneous folding of the two folding lateral sides (13) of the railing, and therefore the collapse of the railing itself to a small height above the car roof (3).

15 Claims, 3 Drawing Sheets

FOREIGN PATENT DOCUMENTS

Figure 1:
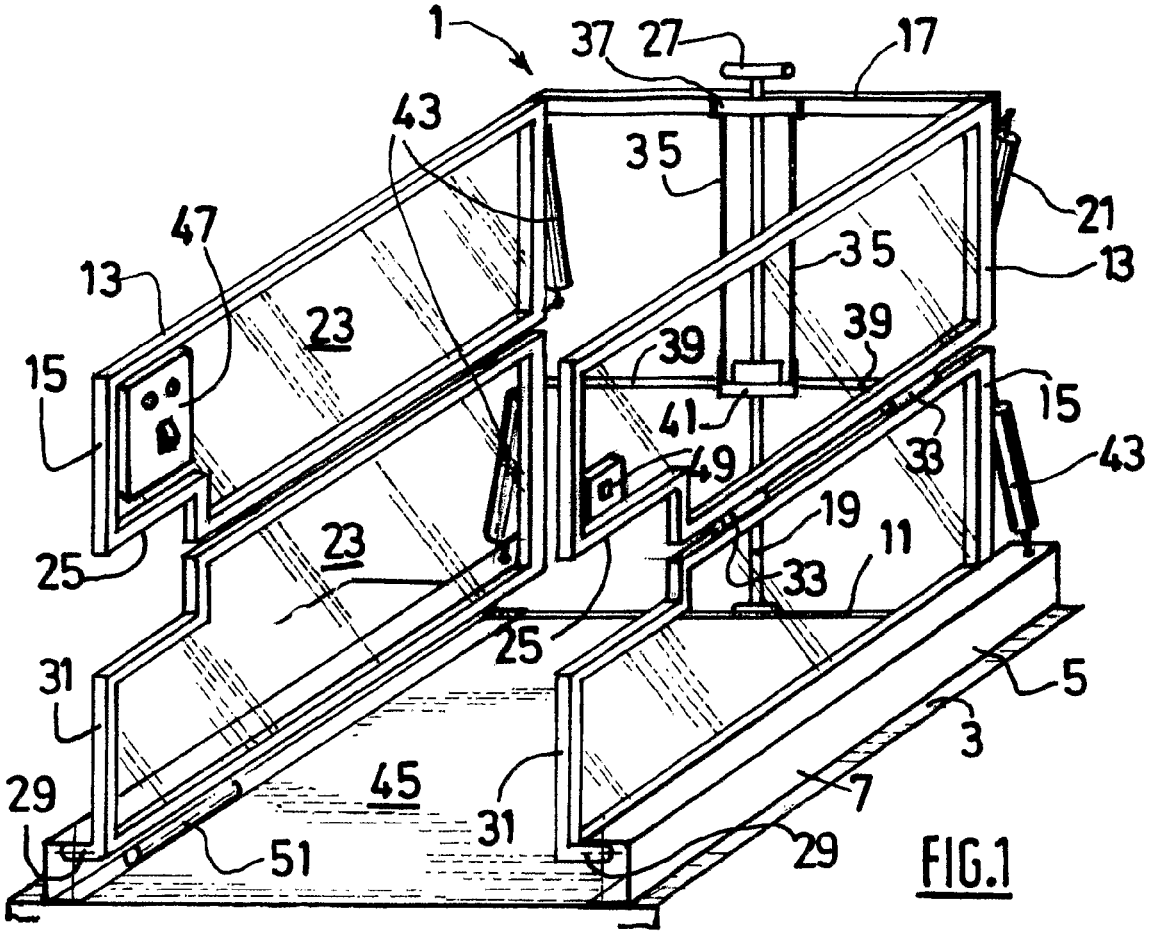

| | | | | |
|---|---|---|---|---|
| JP | 05-292386 | A | * | 10/1992 |
| JP | 08-133617 | A | * | 5/1996 |
| JP | 08-198549 | A | * | 8/1996 |
| JP | 09-263372 | A | * | 10/1997 |
| JP | 10-279223 | A | * | 10/1998 |
| JP | 2002-20062 | A1 | * | 1/2002 |
| WO | 02/085773 | | * | 10/2002 |
| WO | 03/020629 | A | * | 3/2003 |

* cited by examiner

ROOF RAILING FOR AN ELEVATOR CAR ADAPTED TO BE COLLAPSED WITH A HANDLE ACTUATING ALL SIDES AT THE SAME TIME

This invention relates to a roof railing for an elevator car that can be erected and folded away with a handle actuating all sides at the same time.

Elevator car roof railings known in the art are generally erected and folded away one side after another by the operator standing on the car roof, so that the operator is not guarded against falling off the car roof while he is folding the railing sides.

In addition, in narrow cars with a width smaller than 900 mm, the collapsed sides of the railing, which have a set height that is lower than or equal to the width of the car, do not provide a sufficient height when erected to prevent falls, unless they remain tilted with a large space above the car roof, which is not very or not at all compatible with modern elevators in which there is little space at the top of the shaft.

In addition, when the operator has little work to do on the car roof, he may be tempted not to erect the railing if he can access the car roof, and this is a hazardous situation.

This invention aims at solving these disadvantages and provides an elevator car roof railing with collapsible sides hinged on a supporting frame on the car roof, characterized in that it includes:

two sides that can be folded inwards as an accordion in at least two parts, perpendicular to the landing door opening of the elevator shaft and hinged to said supporting frame in their bottom part, an upper rear side bar connected to the rear upper end of each of said folding lateral sides, an actuation handle with a length approximately equal to the depth of the elevator car and hinged to said supporting frame or close thereto, in the rear middle part thereof, perpendicular to said landing door opening in the shaft, wherein this handle is connected at least by a rod hinged in the median plane to the upper rear side bar, and by a lateral rod with a terminal ball-and-socket joint to the rear part of each of the folding lateral sides, wherein said handle can be lifted through the landing door opening from a lower, substantially horizontal position in which the railing is collapsed, to a locked upper position that is substantially vertical, pulling along the two folding lateral sides at the same time to erect them vertically and form the third rear side of the railing with the upper bar on which it is applied and locked and with the rear connecting rods for said lateral sides, and inversely, can be lowered from the upper position to the lower position wherein the displacement of the handle causes the simultaneous folding of the two folding lateral sides of the railing, and therefore the collapse of the railing itself to a small height above the car roof.

Each of the folding sides advantageously comprises two side parts hinged to each other and having the same height, which fold over each other end to end when folded away. Of course, because the sides are folded away in accordion, they can comprise more than two parts, e.g. four parts having a height corresponding to ¼ of the height of the deployed side.

As a result of this arrangement, the railing thus defined is unfolded easily and quickly in one operation as the operator stands in the landing opening, by first lifting the handle to a vertical position locked to the rear upper bar in which the railing is erected, while the fall protection is formed on the sides by the simultaneous deployment of the lateral folding sides and the back side, and inversely, in a second step, releasing the handle from its vertical position to lower it in a collapsed position while the operator returns to the landing opening then to the landing and the railing is then folded away.

The folding side parts are advantageously hinged to each other with lateral hinges allowing one part to collapse over the other when folded, and the deployed position is obtained by internal pressure, possibly using an abutment or an adjustable screw remote from the hinge axis.

The supporting frame may be omitted and replaced by attachment elements attached directly to the car roof.

The height of the railing must obviously be compliant with the safety standards and regulations in force for such devices, meaning that the height of its sides above the car roof must be of at least 700 to 1100 mm, and thus the height of the side plus that of the supporting frame or attachment over the car roof must be at least equal to this required value.

Of course, the railing has a median plane of symmetry including the drive handle, wherein symmetry allows balancing the lateral deployment forces.

The supporting frame or the elements for attachment to the car roof are advantageously located at a given height, in the horizontal direction, above the car roof, said height being relatively low and of e.g. about 100 to 250 mm, and the folding sides connected to their upper part can then have a lower erection height of 1100−250=850 mm, with 425 mm high folding half-sides, which allows equipping elevator cars narrower than 900 mm without having to tilt the folded lateral sides when the railing is collapsed.

Similarly, the lower side of each of the folding sides can be turned inwards, e.g. at right angles, with a lower fold corresponding to the height of the supporting frame or of its attachment elements above the elevator car roof, so that when the railing is collapsed, this lower side comes under the supporting frame or under the attachment elements, at a small height or directly over the supporting frame or its attachment elements.

According to other advantageous characteristics of the invention, said rod for connection to the rear side upper bar can be replaced by two rods parallel to the median plane and spaced equally therefrom, connecting the actuation handle to the rear side upper bar and thus stabilizing the rear bar in its horizontal position when the railing is extended.

The hinged side rods with terminal ball-and-socket joints are advantageously mounted to telescope beyond a given distance after being folded away, being connected with the parallel rods to one same hinge support part mounted to slide on the handle body beyond the fold-away position, wherein the sliding motion causes the handle to travel beyond the actuation for deployment in the horizontal position on the elevator car roof.

In addition, the deployment of the railing may be assisted by means of pneumatic actuators arranged appropriately at the level of the hinge of the lateral folding sides, which reduce the operator's effort to deploy the railing without hindering its collapse.

Of course, the invention also relates to an elevator car with an elevator car safety railing as defined above.

Figure 2:
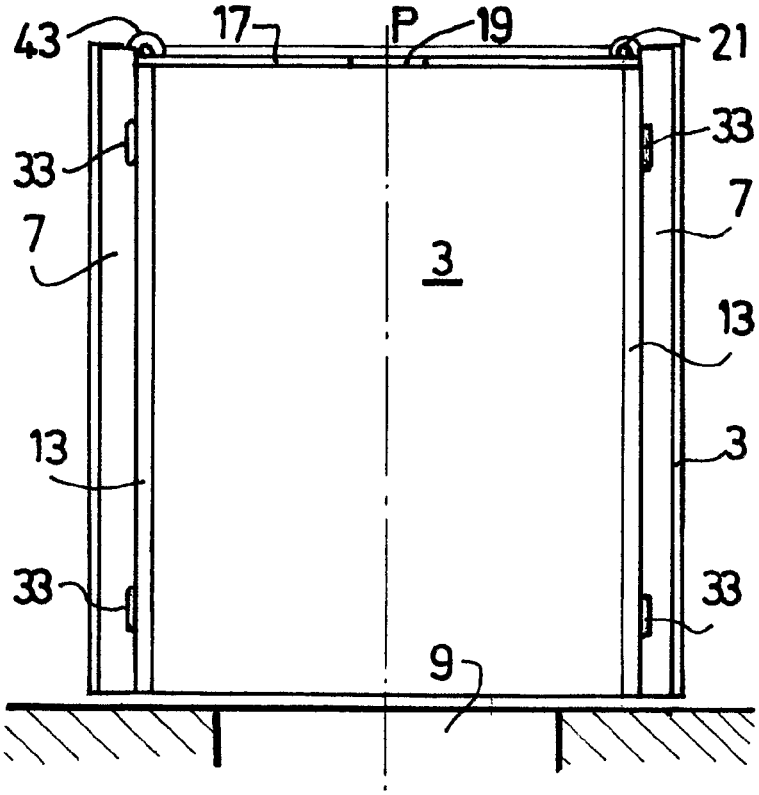
Figure 3:
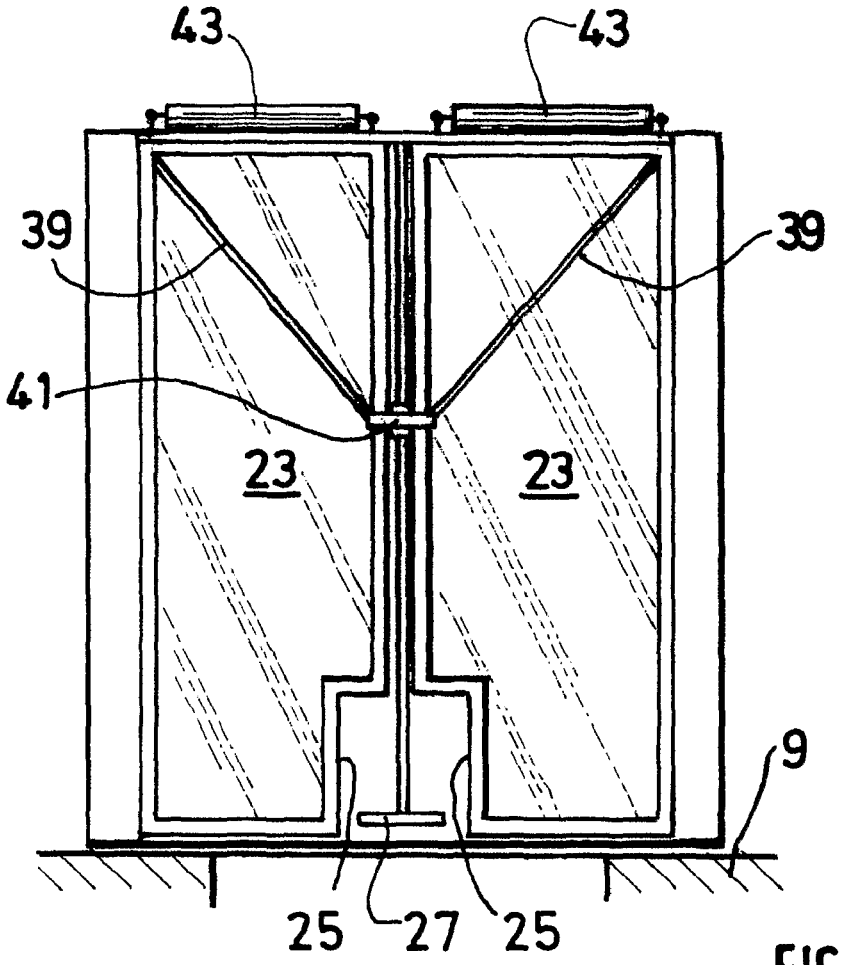
Figure 4:
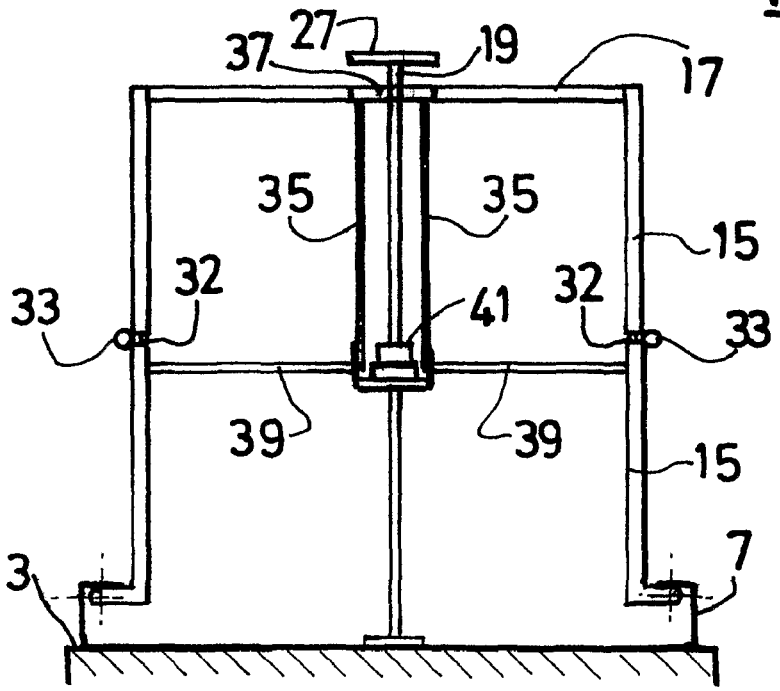
Figure 5:
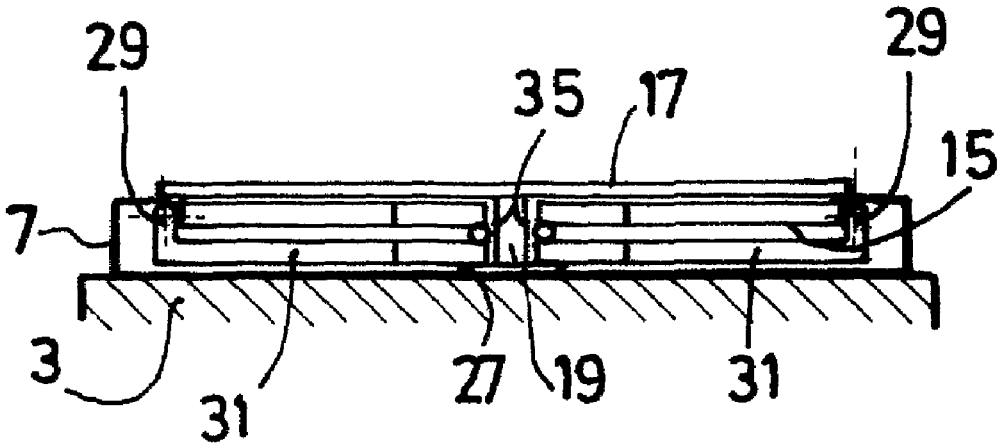
Figure 6:
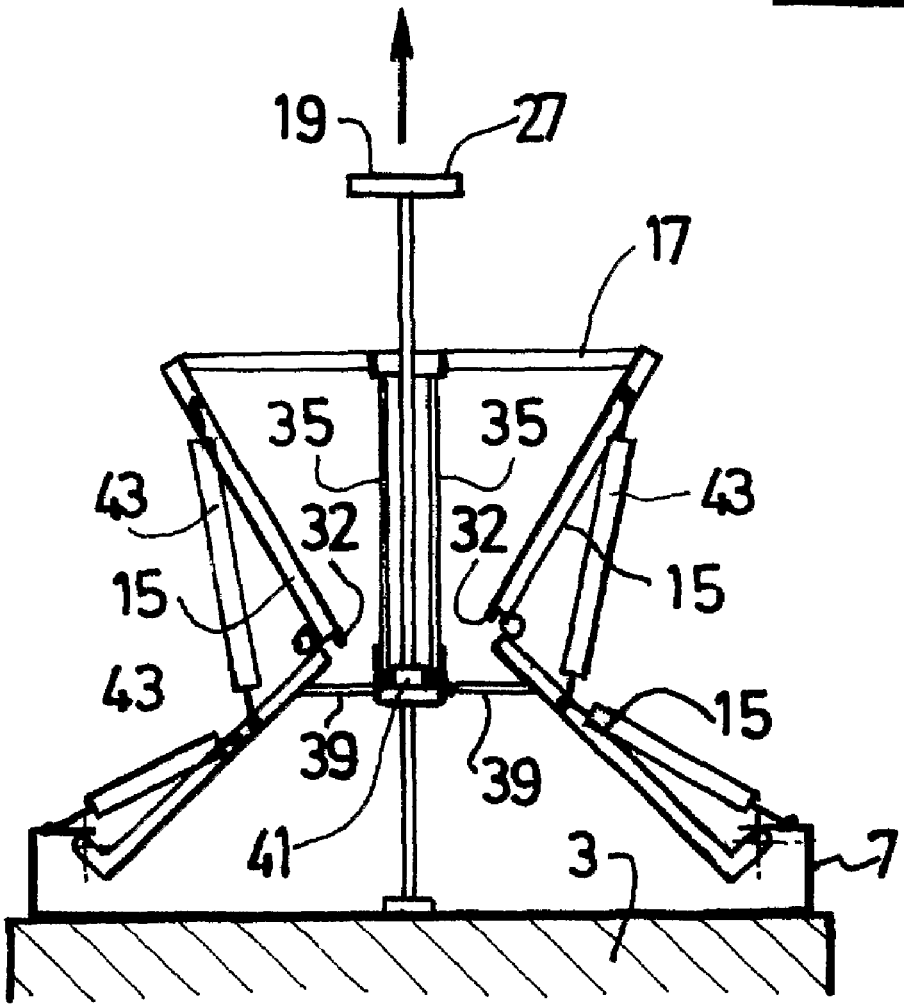

The invention is illustrated below by an exemplary embodiment referring to the appended drawings, in which:

FIG. 1 is a schematic perspective view of an elevator car roof railing according to the invention in the deployed position, FIG. 2 is a top view of the railing corresponding to FIG. 1, FIG. 3 is a top view of the collapsed railing, FIG. 4 is a rear side view of the deployed railing, FIG. 5 is a rear side view of the collapsed railing, and FIG. 6 is a rear side view of the railing being deployed.

Referring now to the figures, and particularly to FIGS. 1, 2, 4 and 6, a railing 1 according to an embodiment of the invention is represented on the roof of an elevator car 3. This railing 3 is mounted on an appropriate supporting frame 5 attached to the car roof 3 and made e.g. of two opposite profile beams 7 with a U-shaped cross-section that each extend along the depth edge of the car roof 3, perpendicular with the landing door opening 9 of the elevator shaft, and of a lower bar 11 on the rear side of the frame 5, which is connected to the lower rear end of each beam 7.

This railing 1 mainly comprises two folding sides 13 made of two parts 15, each hinged on said beams 7 of the supporting frame, a rear side bar 17 connected to the rear upper end of each of said folding sides 13, an actuation handle 19 to deploy the railing, hinged to the rear side 11 of the supporting frame, and a railing deployment assistance device 21.

The two folding sides 13 made of two parts define the lateral sides of the railing relative to the landing door opening 9. These sides each comprise two metal tube frames 15 having the same height (e.g. 450 mm), hinged to each other and collapsible inwards (in accordion shape) to fold away. These are rectangular, with a total width or height upon deployment equal to 900 mm (2×450 mm) and with a length substantially equal to the depth of the car roof. The tube frames 15 each bear a transparent polycarbonate sheet (and possibly a grid) on their surface to shut off the railing. They are provided with a rectangular opening 25 over a small length in their front part, said opening allowing to open a front space in order to reach the holding part 27 of the actuation handle 19 in the folded position from the landing opening. The lower frame or half-side 15 is hinged by its two lateral posts on the upper edge of the edge of the beam 7 of the supporting frame and therefore at some height, e.g. 200 mm, above the car roof. Its side posts are folded at right angles inwards of the supporting frame with a first segment 29 having a slightly shorter length than the height of the beam 7 and with a second segment 31 having the same height as the corresponding half-side 15, i.e. 450 mm. This arrangement allows bringing the first segment 29 inside the beam 7 during collapse and thus lifting the railing from the roof without increasing the height of the half sides.

The height of the railing in the present case is that of the supporting beam 7 and the sum of the half-sides 15, i.e. 200+450+450=1100 mm, which is the required value according to the standards and regulations in force for the height of the railing above the elevator car roof.

The half-sides 15 are hinged to each other along an external axis line of the hinges 33 and abut inside in the vertical erected position, optionally with an adjustable screw 32.

The rear side bar 17 forms the upper part or handrail of the rear side of the railing. This bar is connected to the actuation handle 19 by means of two rods 35 parallel to the hinge plane thereof or the middle plane P of the railing, each being hinged on either side of the handle 19 substantially in its middle part, and hinged to the bar 17. The rods 35 are telescopic beyond side collapse to follow the horizontal lowering of the handle 19 after its driving action to deploy the railing. The rear side bar 17 is movable in height, horizontally, from a lower position (FIG. 5) in which the handle 19 is lowered as the railing is collapsed to an upper position in which the handle 19 is lifted and locked in the vertical position (FIG. 4).

This handle 19, which is approximately as long as the car's depth, comprises a simple tubular bar with a holding grip 27 and a hook 37 for attachment to the rear bar 17 at its front or upper end, wherein the handle is hinged at its back (lower) end to said bar 11 on the rear side of the supporting frame.

The actuation handle 19 is also connected to each of the folding lateral sides 13 by means of a transverse rod 39 with a terminal ball-and-socket joint, telescoping beyond the side folding drive, and symmetrical to the opposite rod 39 relative to the median plane, wherein this rod is hinged substantially to the upper part of the lower folding side part 15 and to the middle part of the actuation handle 19, at the same level as the parallel rods 35 on a corresponding hinge bearing part 41 attached to the handle 19. This hinge bearing part 41 is mounted to slide on the handle bar 19 beyond the side folding drive to allow the handle to be returned to a horizontal position (FIG. 3) while sliding at the end of lowering. The parallel rods 35, transverse rods 39 and hinged part 41 actually have a free residual stroke where they respectively telescope and slide synchronously to enable the handle 19 to descend horizontally into the collapsed position of the railing. Inversely, when not on the residual stroke, they actuate the simultaneous deployment of the sides (FIG. 6) and of the upper bar of the railing.

This hinged set thus causes the deployment of the folding sides 13 in relation with the bar 17 as the handle 19 is turned, respectively from the folded position where the handle 19 is lowered to the erected position where the handle 19 is lifted and locked in position with the bar 17 by the hook 37 (FIG. 4). In addition, in the erected position, it forms the rear side of the railing, with the transverse rods 39 placing themselves approximately at mid-height and horizontally.

The hook 37 may be clevis mounted to slide on the handle body and optionally being part of the handle 27, and is lowered for engagement with the bar 17.

The railing deployment assistance device 21 represented only in FIGS. 1, 2, 3 and 6 for clarity consists in a set of four pneumatic actuators 43 arranged on the rear side of the railing symmetrically relative to the middle plane P. It respectively comprises two bottom actuators hinged to the rear lower part of the supporting frame beams 7 and to the upper part of the lower folding side part 15, and two top actuators hinged to the upper part of the lower half-side 15 and to the upper part of the corresponding upper half-side 15, with the appropriate lateral offset to provide a favorable thrust force to deploy the railing (without hindering its collapse) as the actuation handle rises. These actuators 43 have a nonlinear variable pressure according to the position of the railing.

The railing now operates as follows.

Suppose that a maintenance operator must access the roof 3 of the elevator car for a given maintenance operation. He will have to open the corresponding landing door or any other access provided, in order to access the elevator shaft and to bring the car to the appropriate level for him to access the car roof. The railing 1 is folded away (FIGS. 3, 5) and the holding handle 27 is directly accessible at the front of the car roof. The collapsed half-sides 15 covered with a polycarbonate protection sheet 23 prevent access to the car roof. The operator simply has to grab and lift the actuation handle 19 while advancing on the roof, while the folding sides 15 rise. Little effort must be exerted on the handle 19 and the process is easy and safe. At the end of travel of the handle 19, when the handle rests vertically against the bar 17, the operator simply must arrange the attachment hook 37 on the bar 17 to lock the handle bar 19 on the bar 17. The railing is then erected and the operator can work safely on the car roof inside the protective railing.

When work is finished, the operator proceeds in reverse order, removing the handle 19 from the bar 17 by unfastening the hook 37 and then lowering the handle until the railing has collapsed as he moves back towards the landing door opening 9 at the corresponding floor of the building. This is therefore an easy, simple and safe process.

Finally, it should be noted that the railing (FIG. 1) can be constructed as a car roof set attached by its supporting frame to the car roof itself 3 and comprising a flat floor 45 raised above the raw car roof 3 and making it easier for the maintenance operator to stand upright and safely, an inspection box 47 attached to the front part of the upper folding half-side 15 and accessible in the collapsed position through the opening of the landing door 9, two control switches 49 mounted on one side 13 or each one on a side 13 of the railing opposite each other, to be actuated at the same time each by one of the operator's hands to prevent the operator from spreading his arms during actuation, and other accessories such as lighting devices 51 to illuminate the elevator car roof.

The invention claimed is:

1. An elevator car roof railing with collapsible sides hinged on a supporting frame on the car roof, comprising:

two sides that can be folded inwards as an accordion in at least two parts, perpendicular to a landing door opening of the elevator shaft and hinged to said supporting frame near a bottom part of the sides;

an upper rear side bar connected near a rear upper end of each of said two sides;

an actuation handle with a length approximately equal to a depth of the elevator car and hinged near said supporting frame near a rear middle part thereof, perpendicular to said landing door opening, wherein the handle is connected at least by a rod hinged in a median plane to the upper rear side bar, and by a lateral rod with a terminal ball-and-socket joint to the rear part of each of the two sides, wherein said handle is configured to be lifted through the landing door opening from a lower, substantially horizontal position in which the railing is collapsed, to a locked upper position that is substantially vertical, pulling along the two sides at the same time to erect them vertically and form a third rear side of the railing with rear connecting rods of said two sides and the upper rear side bar on which it is applied and locked, and is configured to be lowered from the upper position to the lower position such that displacement of the handle causes simultaneous folding of the two sides and collapse of the railing to a small height above the car roof.

2. The elevator car roof railing as per claim 1, wherein each of the two sides comprises two side parts hinged to each other and having the same height, which fold over each other end to end when folded away.

3. The elevator car roof railing as per claim 1, wherein the two sides are folded away in accordion, and each of the two sides comprises a plurality of folding side parts, each having a height corresponding to an equal portion of a total height of the corresponding side.

4. The elevator car roof railing as per claim 3, wherein the folding side parts are hinged to each other with lateral hinges allowing one part to collapse over the other when folded, and the deployed position is obtained by internal pressure.

5. The elevator car roof railing as per claim 4, comprising one of an abutment or an adjustable screw remote from the axis of the hinge.

6. The elevator car roof railing as per claim 1, wherein the supporting frame comprises attachment elements attached directly to the car roof.

7. The elevator car roof railing as per claim 1, comprising a median plane of symmetry.

8. The elevator car roof railing as per claim 1, wherein the supporting frame is located at a given height, in a horizontal direction, above the car roof, which height is about 100 to 250 mm.

9. The elevator car roof railing as per claim 1, wherein a lower side of each of the two sides is turned inwards, with a lower fold corresponding to a height of the supporting frame above the elevator car roof, so that when the railing is collapsed, this lower side comes under the supporting frame.

10. The elevator car roof railing as per claim 1, wherein said rod hinged to the upper rear side bar comprises two rods parallel to the median plane and spaced equally therefrom, connecting the actuation handle to the upper rear side bar and thus stabilizing the upper rear side bar in its horizontal position when the railing is extended.

11. The elevator car roof railing as per claim 10, wherein the lateral rod with a terminal ball-and-socket joint comprises a plurality of rods that are connected with the two parallel rods to one same hinge support part mounted to slide on the handle body, the two parallel rods, lateral rods and hinged part have a free residual stroke for respectively telescoping and sliding synchronously to enable the handle to descend horizontally into the collapsed position of the railing and to also move to cause the two sides and the upper bar of the railing to deploy simultaneously.

12. The elevator car roof railing as per claim 1, comprising pneumatic actuators arranged near the level of the hinge of the two sides, for reducing an operator's effort to deploy the railing without hindering an intended collapse of the railing.

13. The elevator car roof railing as per claim 1, wherein the supporting frame comprises a flat floor raised above the car roof.

14. The elevator car roof railing of claim 1, comprising an inspection box attached to a front part of one of the two sides and accessible in the collapsed position through the opening of the landing door;

two control switches mounted on a side of the railing, to be actuated at the same time, each by one of an operator's hands to prevent an operator from spreading his arms during actuation.

15. The elevator car roof railing of claim 1, comprising at least one lighting device to illuminate the elevator car roof.

* * * * *

UNITED STATES PATENT AND TRADEMARK OFFICE

CERTIFICATE OF CORRECTION

PATENT NO. : 7,510,056 B2
APPLICATION NO. : 11/816544
DATED : March 31, 2009
INVENTOR(S) : Bonatre It is certified that error appears in the above-identified patent and that said Letters Patent is hereby corrected as shown below:

Claim 1, Column 5, Line 2: Change “the” to “an”

Signed and Sealed this

Thirtieth Day of June, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,510,056 B2
APPLICATION NO. : 11/816544
DATED : March 31, 2009
INVENTOR(S) : Bonatre It is certified that error appears in the above-identified patent and that said Letters Patent is hereby corrected as shown below:

Claim 1, Column 5, Line 18: Change “the” to “an”

This certificate supersedes the Certificate of Correction issued June 30, 2009.

Signed and Sealed this

Twenty-eighth Day of July, 2009

JOHN DOLL
*Acting Director of the United States Patent and Trademark Office*